US007497512B2

(12) United States Patent
White et al.

(10) Patent No.: US 7,497,512 B2
(45) Date of Patent: Mar. 3, 2009

(54) RECLINER DRIVE MECHANISM FOR A ROCKER CHAIR

(75) Inventors: Nikki White, Pontotoc, MS (US); Bill D. Tacker, Smithville, MS (US); Terry D. Johnson, Mantachie, MS (US)

(73) Assignee: L & P Property Management Company, South Gate, CA (US)

( * ) Notice: Subject to any disclaimer, the term of this patent is extended or adjusted under 35 U.S.C. 154(b) by 269 days.

(21) Appl. No.: 11/135,167

(22) Filed: May 23, 2005

(65) Prior Publication Data

US 2006/0273631 A1 Dec. 7, 2006

(51) Int. Cl.
*A47C 1/02* (2006.01)

(52) U.S. Cl. ..... 297/85; 297/89

(58) Field of Classification Search ..... 297/84, 297/85, 89; 248/421, 396, 370
See application file for complete search history.

(56) References Cited

U.S. PATENT DOCUMENTS

| | | | | | |
|---|---|---|---|---|---|
| 2,869,617 | A | * | 1/1959 | Schliephacke | 297/85 |
| 3,012,816 | A | * | 12/1961 | Lorenz et al. | 297/85 |
| 3,163,464 | A | * | 12/1964 | Martin et al. | 297/85 |
| 3,279,847 | A | | 10/1966 | Re | |
| 3,322,459 | A | * | 5/1967 | Hampton | 297/85 |
| 3,379,473 | A | * | 4/1968 | Mizelle | 297/269.1 |
| 3,622,198 | A | | 11/1971 | Re | |
| 3,637,255 | A | * | 1/1972 | Re | 297/85 |
| 3,747,973 | A | | 7/1973 | Re | |
| 4,025,113 | A | | 5/1977 | Rogers, Jr. | |
| 4,319,780 | A | | 3/1982 | Rogers, Jr. | |
| 4,579,647 | A | | 4/1986 | Smith | |
| 4,707,025 | A | | 11/1987 | Rogers, Jr. | |
| RE33,704 | E | | 10/1991 | Rogers, Jr. | |
| 5,121,697 | A | | 6/1992 | Baum et al. | |
| 6,000,754 | A | | 12/1999 | Lawson | |
| 6,733,071 | B2 | | 5/2004 | Guillot et al. | |
| 6,769,734 | B2 | | 8/2004 | Tacker | |
| 6,918,632 | B2 | | 7/2005 | Maki et al. | |

* cited by examiner

*Primary Examiner*—Joseph F Edell
(74) *Attorney, Agent, or Firm*—Shook, Hardy & Bacon L.L.P.

(57) ABSTRACT

This invention is related to a mechanism for use in a rocker recliner chair that reduces the complexity and links of typical linkage mechanisms. The rocker recliner chair includes a base, a rocker cam assembly mounted on the base, a seat, a footrest, a backrest and a pair of linkage mechanisms mounted on opposite sides of the chair. Each of the linkage mechanisms includes a recliner mechanism, a drive mechanism, and a footrest mechanism. The recliner mechanism is coupled to the base. The drive mechanism includes an ottoman drive bell crank and an ottoman drive link. The ottoman drive bell crank is coupled to a rear portion of the recliner mechanism. The ottoman drive link couples the ottoman drive bell crank to the footrest mechanism. The footrest mechanism is connected to the recliner mechanism by a footrest extension linkage. The footrest extension linkage serves to unlock the footrest mechanism thereby allowing the weight of the user, along with the drive mechanism, to move the chair from the chair position to the recliner position.

11 Claims, 8 Drawing Sheets

RECLINER DRIVE MECHANISM FOR A ROCKER CHAIR

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to a recliner mechanism for a rocker recliner chair, and more particularly to a drive mechanism for a rocker recliner chair that is capable of moving the chair from a closed position to an open, reclined position, then to a fully reclined position.

Rocker recliners are generally well known in the furniture industry. Typically, rocker recliners are chairs with extendable footrests that allow the user to recline. Rocker recliner chairs usually contain a linkage mechanism comprised of a footrest mechanism, a recliner mechanism, and a drive mechanism. A rocker recliner chair typically has three positions in use: a closed, stowed position, an open, reclining position, and a fully-reclined position. The drive mechanism operates to move the footrest mechanism and the recliner mechanism between these three positions. When the footrest and recliner mechanisms are in the closed/stowed position, the chair is allowed to rock back-and-forth like a typical rocking chair. However, when the footrest and recliner mechanisms are in either the open, reclining position or the fully-reclined position, a portion of the drive mechanism contacts the base and prevents the chair from rocking back and forth. Currently, a number of different link configurations are used in the drive mechanism for moving the rocker recliner chair between the three positions. The linkage configurations that are currently in use involve complex mechanisms with an extremely high number of links and connections. The high number of links and connections results in a drive mechanism with a large number of moving parts. The high number of moving parts translates into greatly increased maintenance costs and production costs, namely; high machining costs, material costs, and assembly costs.

Thus, while rocker recliner linkage mechanisms are known, there remains a need for an improved drive mechanism for a rocker recliner that achieves the same function with a reduced number of moving parts and connections for ease of operation and decreased production costs.

BRIEF SUMMARY OF THE INVENTION

Accordingly, the present invention provides a drive mechanism for a rocker recliner chair with a reduced number of working parts. The drive mechanism of the present invention moves the rocker recliner chair between a closed, chair position, an open, recliner position, and a fully-reclined position. A brief overview of the recliner and its components follows immediately below. A more detailed description is provided in the Detail Description of the Invention section.

In general, the rocker recliner chair includes a base, a rocker cam assembly mounted on the base, a seat, a footrest, a backrest and a pair of linkage mechanisms mounted on opposite sides of the chair. Each of the linkage mechanisms includes a recliner mechanism, a drive mechanism, and a footrest mechanism. The recliner mechanism is coupled to the base. The drive mechanism is coupled to the recliner mechanism at a first end and to the footrest mechanism at an opposite end. The footrest mechanism is connected to the recliner mechanism by a footrest extension linkage. The footrest extension linkage serves to unlock the footrest mechanism thereby allowing the weight of the user, along with the drive mechanism, to move the chair from the chair position to the recliner position.

The recliner mechanism broadly includes a rocker base plate, a seat mount plate, a front pivot link, a lift linkage, and a back linkage. The rocker base plate is mounted on the rocker cam assembly. The front pivot link couples the lift linkage to the rocker base plate while the lift linkage couples the front pivot link and the rocker base plate to the seat mount plate. The back linkage couples the seat mount plate to the rocker base plate.

The drive mechanism includes an ottoman drive bell crank and an ottoman drive link. The ottoman drive bell crank is coupled to a rear portion of the recliner mechanism. The ottoman drive link couples the ottoman drive bell crank to the footrest mechanism. Thus, the ottoman drive link is used to interconnect the ottoman drive bell crank and the footrest mechanism. This connection enables the drive mechanism along with the footrest extension linkage to move the footrest mechanism from the closed position to the open, extended position.

In operation, to move the recliner from the closed, chair position to the open, recliner position, the user rotates a release lever or other activation means rearwardly. The rearward rotation of the lever or other activation means serves to unlock the footrest extension linkage, thereby allowing the weight of the user to move the recliner mechanism from the closed, chair position to the open, recliner position. The unlocking of the footrest extension linkage also allows the drive mechanism to assist in moving the footrest mechanism from the closed, chair position to the open, recliner position. The user may then fully recline the chair by pushing back on the backrest. The rearward force engages the back linkage. This rearward motion of the back linkage engages the lift linkage and drive mechanism and causes the seat to rise. The rearward motion of the back linkage also moves the recliner mechanism from the open, recliner position to the fully-reclined position.

As will be seen from the detailed description that follows, the mechanism of the invention provides a drive mechanism for a rocker recliner chair that utilizes fewer working parts than any of the previous embodiments contained in the prior art. Additional advantages, and novel features of the invention will be set forth in part in a description which follows, and in part will become apparent to those skilled in the art upon examination of the following, or may be learned by practice of the invention.

BRIEF DESCRIPTION OF THE SEVERAL VIEWS OF THE DRAWING

In the accompanying drawings which form a part of the specification and which are to be read in conjunction therewith, and in which like reference numerals are used to indicate like parts in the various views.

DETAILED DESCRIPTION OF THE INVENTION

Figure 1:
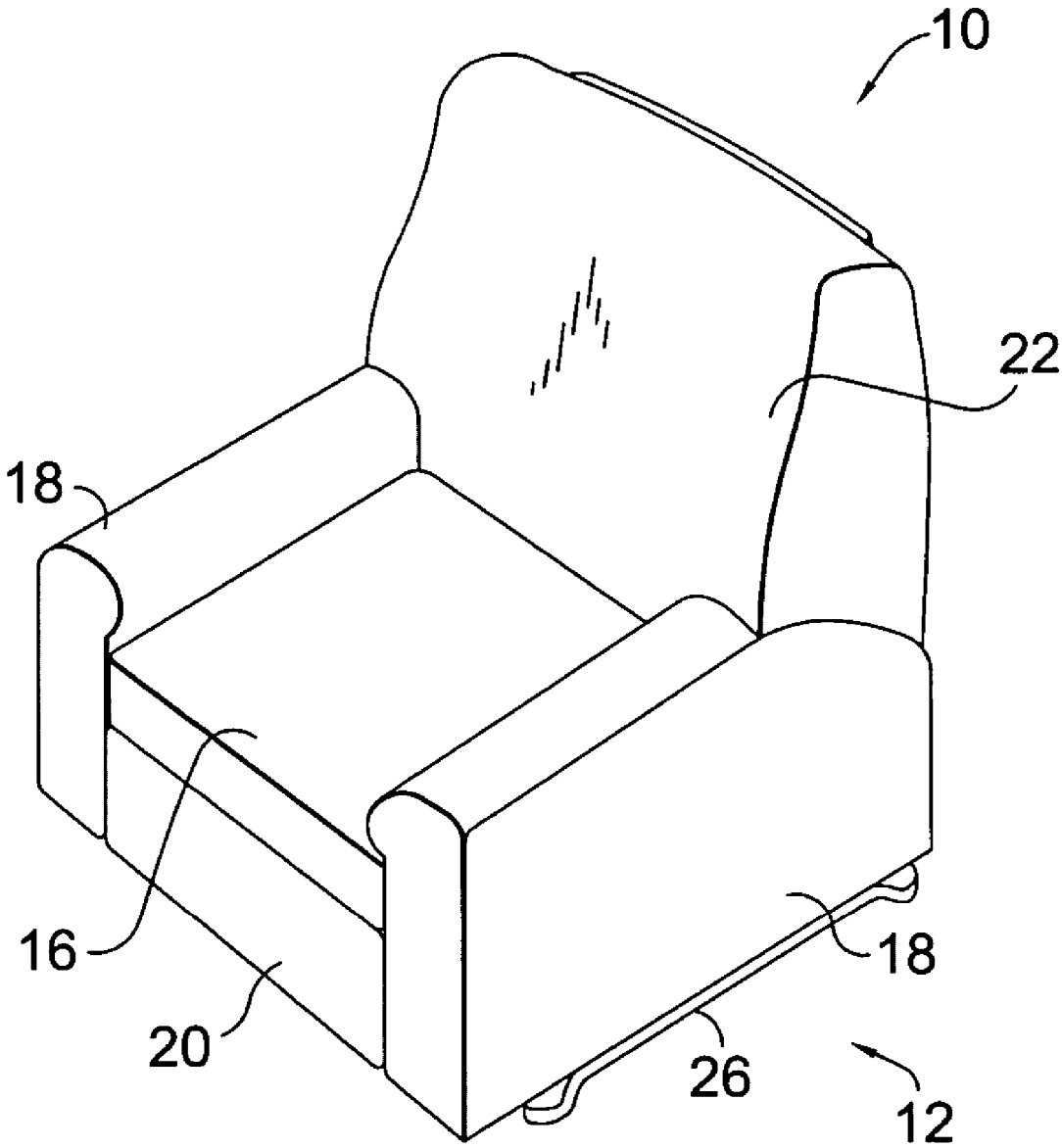
FIG. 1 is a front perspective view of a rocker recliner chair in the closed, chair position according to the present invention.

Referring to the drawings in greater detail and initially to FIG. 1, a rocker recliner chair is shown and designated generally by the numeral 10.

Figure 2:
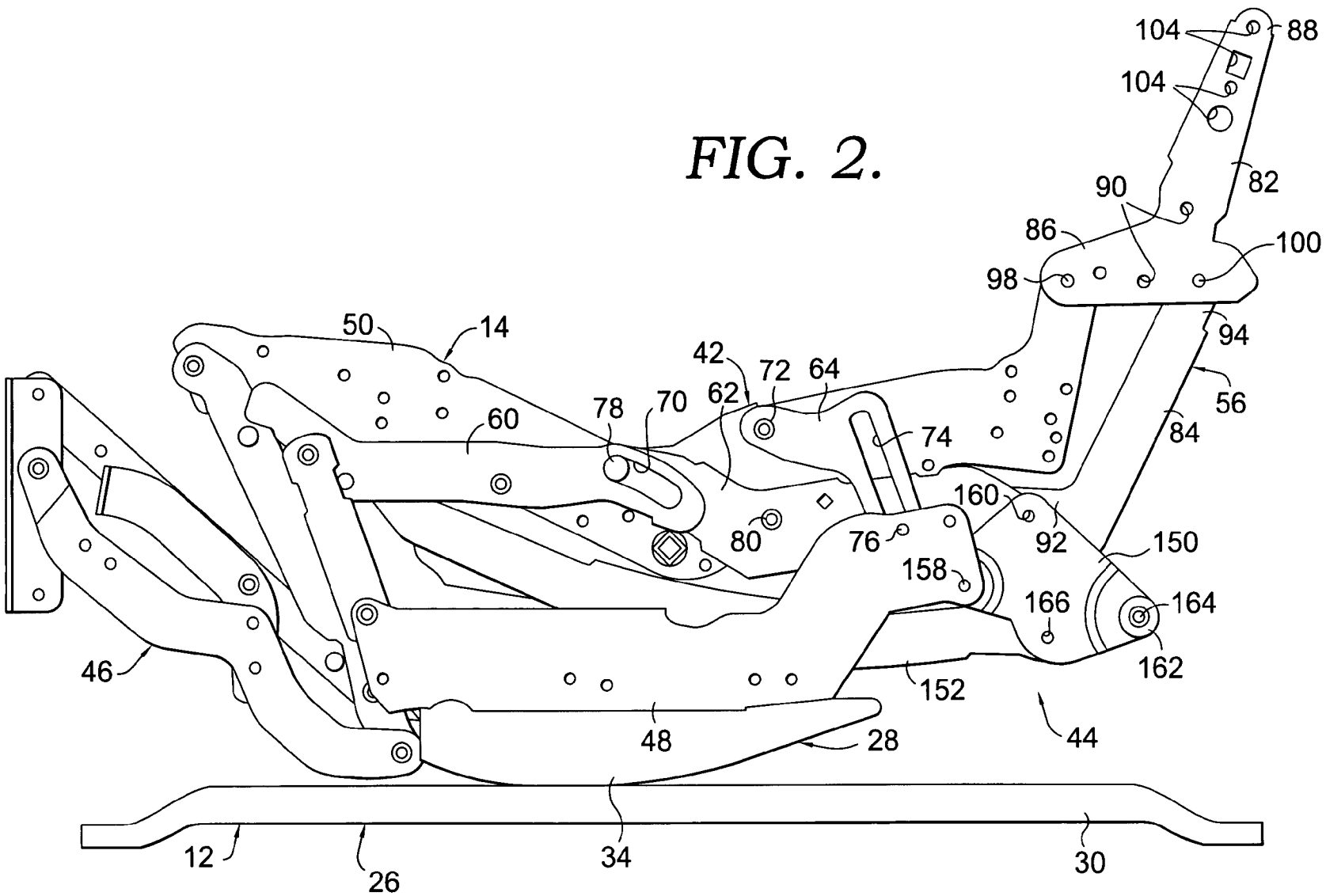
FIG. 2 is a enlarged cross-sectional view of a rocker recliner mechanism showing the mechanism in the closed, chair position.
Figure 3:
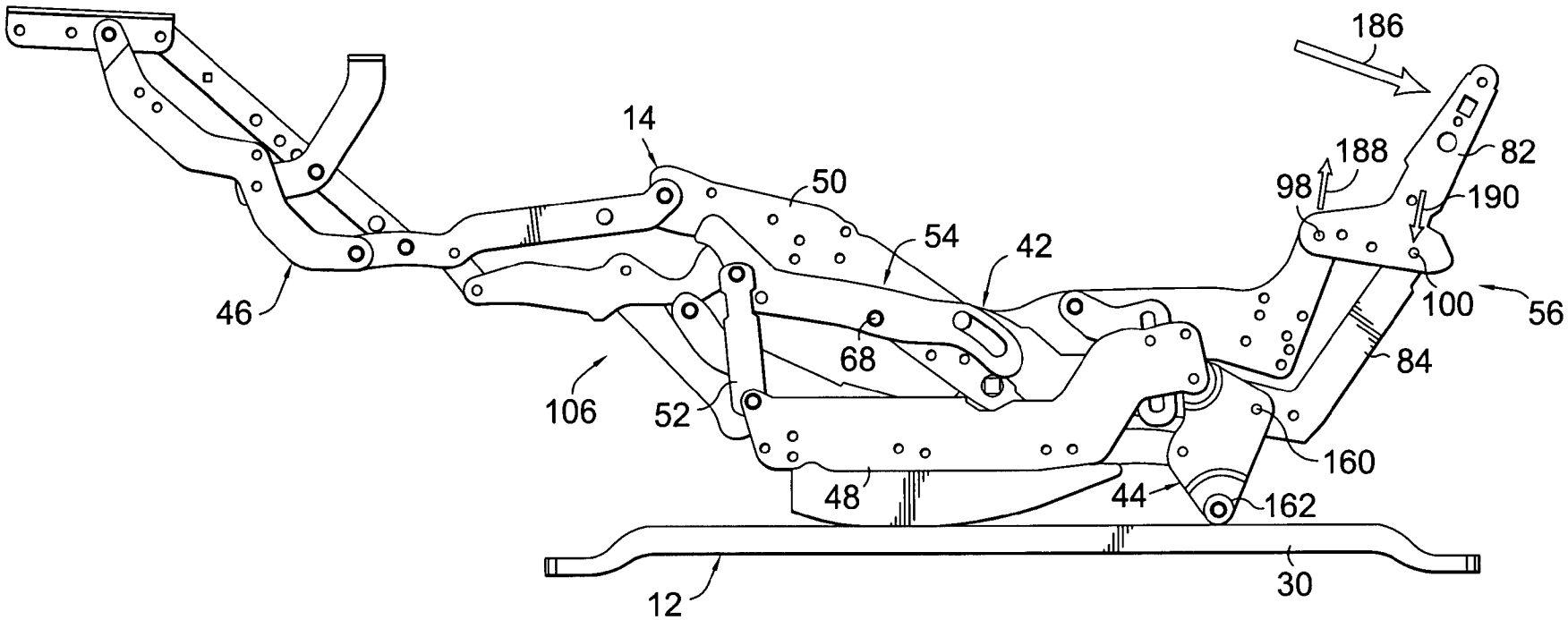
FIG. 3 is a cross-sectional view a rocker recliner mechanism showing the mechanism in the open, recliner position.

Generally, as best seen in FIGS. 1 and 2, the chair 10 broadly includes a support frame 12 that provides support for a pair of linkage mechanisms 14 positioned on opposite sides of the chair 10. Linkage mechanisms 14 mount a seat 16, a pair of upstanding opposed armrests 18, a footrest 20 and a backrest 22 to the frame 12 for movement between an upright position as best seen in FIG. 2, an intermediate position as best seen in FIG. 3, and a fully reclined position as best seen in FIG. 4.

Figure 6:
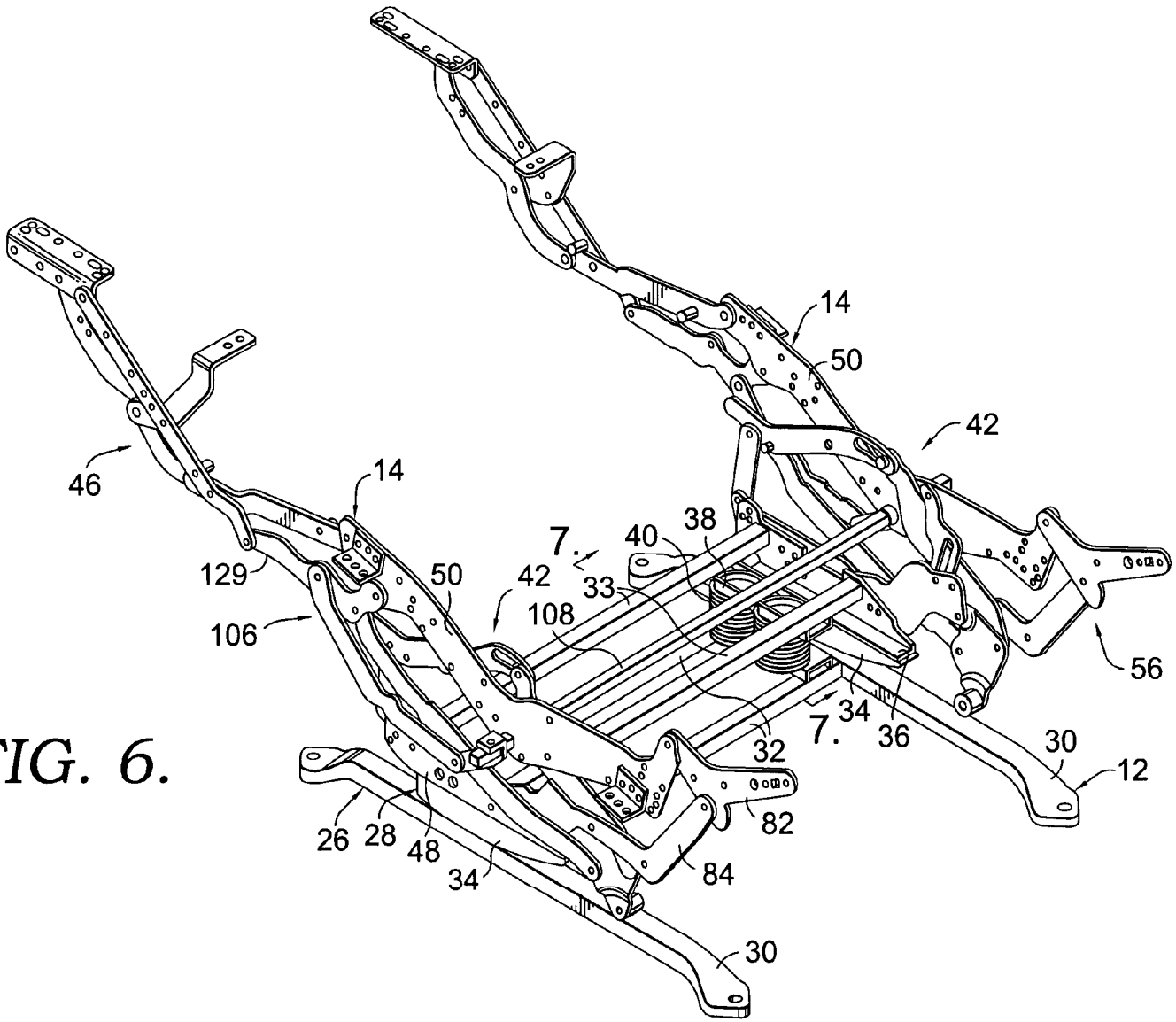
FIG. 6 is an isometric view of the rocker recliner mechanism.
Figure 7:
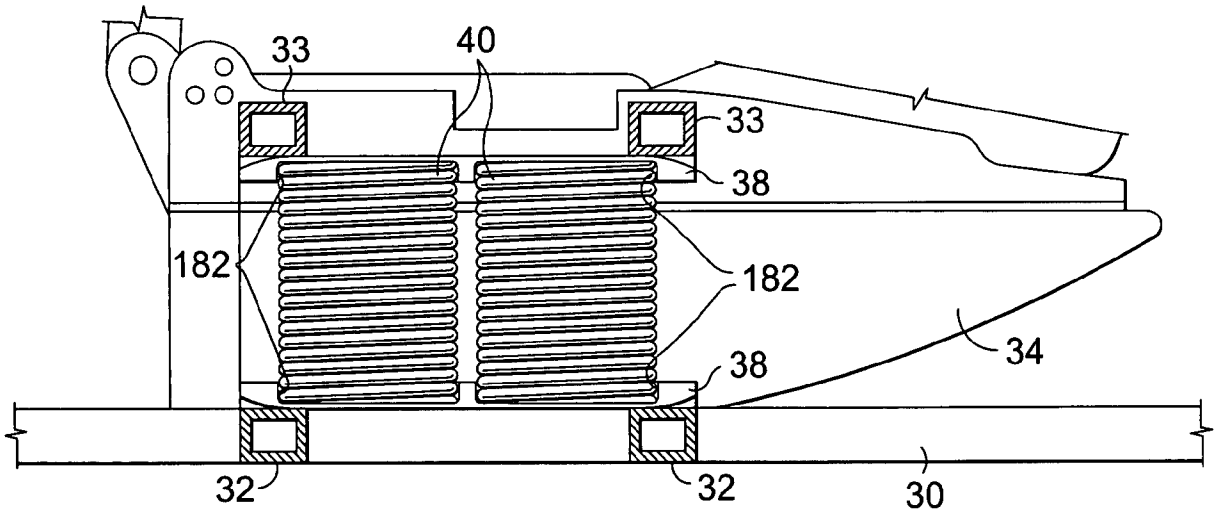
FIG. 7 is an enlarged cross-sectional view of the spring connection configuration taken along the lines 7-7.

Referring now to FIGS. 2 and 6, the support frame 12 will be discussed. The support frame 12 includes a base 26 and a rocker cam assembly 28. The base 26 includes a pair of side rails 30 positioned on opposite sides of chair 10 and extending between front and rear portions of chair 10. A first pair of cross rails 32 interconnect the side rails 30 and extend between the sides of chair 10. The rocker cam assembly 28 includes a pair of rocker cams 34 and a pair of mounting brackets 36. A second pair of cross rails 33 interconnect the mounting brackets 36. The rocker cams 34 rest on the side rails 30 on opposite sides of the base 26 and allow for forward and rearward rocking of the chair 10 when the linkage mechanism 14 is in the closed position. The mounting brackets 36 are fixably coupled to an upper portion of the rocker cams 34. As seen in FIGS. 6 and 7, and as further discussed below, a pair of spring retention devices 38 are coupled to the first and second pairs of cross rails 32, 33 with a set of springs 40 mounted therebetween.

Referring again to FIGS. 1 and 2, the seat 16 is mounted to support frame 12 on opposite sides of chair 10 by the linkage mechanisms 14, as will be appreciated by one of ordinary skill in the art. As best seen in FIGS. 2-4, the linkage mechanism 14 broadly includes a recliner mechanism 42, a drive mechanism 44, and a footrest mechanism 46. The recliner mechanism 42 is fixably coupled to the support frame 12. The drive mechanism 44 is rotatably coupled to the recliner mechanism 42 at a first end and rotatably coupled to the footrest mechanism 46 at an opposite end. The footrest mechanism 46 is rotatably coupled to the recliner mechanism 42.

Figure 4:
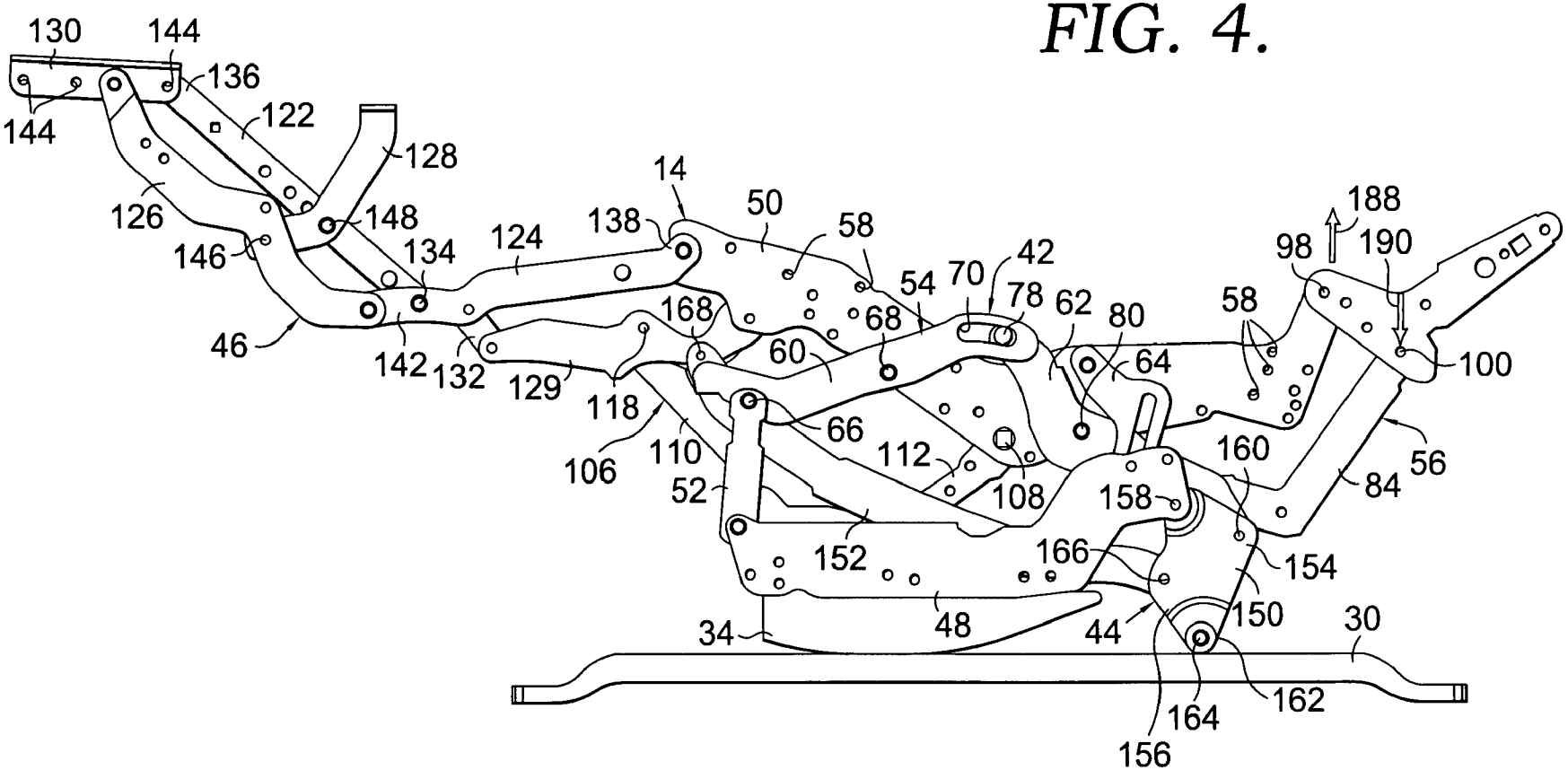
FIG. 4 is a view similar to FIG. 3, but with the rocker recliner mechanism in the fully-reclined position.

Referring now to FIG. 4, the recliner mechanism 42 is discussed in detail. The recliner mechanism 42 broadly includes a rocker base plate 48, a seat mount plate 50, a front pivot link 52, a lift linkage 54, and a back linkage 56. The rocker base plate 48 is fixably mounted on the rocker cam 34. The front pivot link 52 serves to interconnect the rocker base plate 48 and the lift linkage 54. A lower portion of front pivot link 52 is rotatably coupled to the rocker base plate 48, while an upper portion of front pivot link 52 is rotatably coupled to the lift linkage 54. The lift linkage 54 includes a front lift link 60, a rear lift link 62, and a sequence link 64. The front lift link 60 contains apertures 66, 68, shown as connections, and a slot 70. The front lift link 60 is rotatably coupled to an upper portion of front pivot link 52 at aperture 66. An intermediate portion of the front lift link 60 is rotatably coupled to the seat mount plate 50 at aperture 68. Rear lift link 62 contains an outwardly projecting pin 78 at its forward end. The forward end of rear lift link 62 is slidably and pivotably connected to the slot 70 of the front lift link 60 at pin 78. An intermediate portion of rear lift link 62 is rotatably coupled to the seat mount plate 50 at point 80. The seat mount plate 50 is an elongated piece of stamped steel, shaped as shown, with a plurality of connecting apertures 58. As will be understood from the description below, various other linkages and links are coupled to the seat mount plate 50.

Referring now to FIG. 2, the sequence link 64 will be discussed. The sequence link 64 is generally L-shaped and includes an aperture 72 and a slot 74. Sequence link 64 is rotatably coupled to the seat mount plate 50 at aperture 72. Further, slot 74 of sequence link 64 is slidably coupled to the rocker base plate 48 at point 76. Thus, sequence link 64 serves to interconnect the seat mount plate 50 and the rocker base plate 48.

Figure 5:
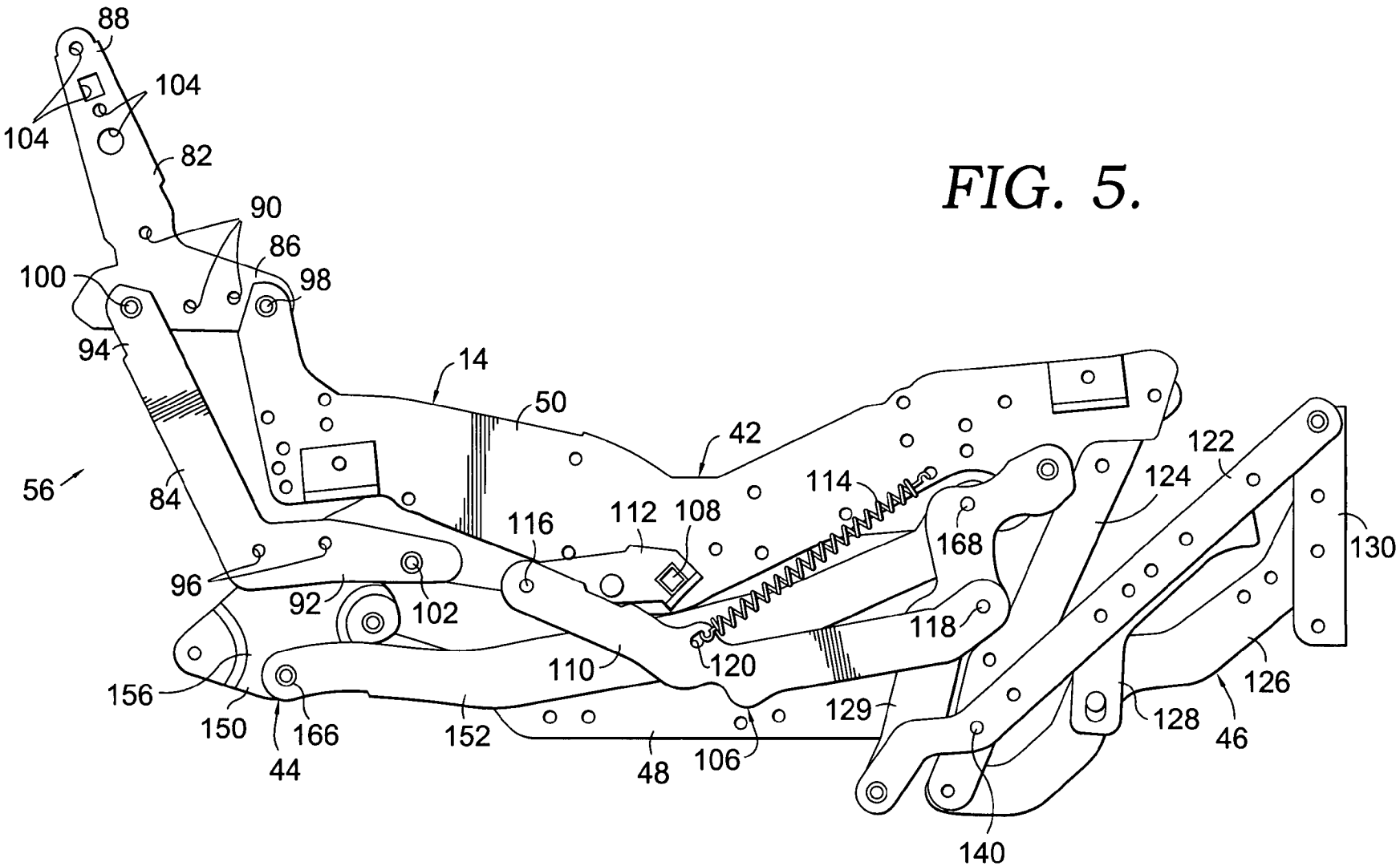
FIG. 5 is a view similar to FIG. 2, but showing the opposite side with the support frame removed.

Referring now to FIGS. 2 and 5, the back linkage 56 is shown. The back linkage 56 is coupled to the seat mount plate 50. The back linkage 56 generally includes a back bracket 82 and an upright link 84. Back bracket 82 is generally L-shaped and includes a lower leg 86, an upper leg 88, and a number of apertures 90. The upright link 84 is generally L-shaped and includes a lower leg 92, an upper leg 94, and a number of apertures 96. A front portion of lower leg 86 is rotatably coupled to the seat mount plate 50 at point 98. A rear portion of lower leg 86 is rotatably coupled to the upper leg 94 at point 100. Lower leg 92 is rotatably coupled to the rear lift link 62 at point 102. Again, any suitable attachment mechanism could be used, such as screws, bolts, pins, rivets or the like. Upper leg 88 of back bracket 82 contains a mounting configuration 104 used to couple it to back 20, not shown, as is well understood in the art. Apertures 90 and 96 are generally used to interconnect linkage mechanisms 14 via cross links, not shown, as is well understood in the art.

Returning to FIGS. 4 and 5, and the discussion of the linkage mechanism 14, the footrest mechanism 46 is connected to the recliner mechanism 42 by a footrest extension linkage 106. It will be understood that the footrest extension linkage 106 cooperates with the footrest mechanism 46 to place the footrest mechanism 46 in a retracted position as best seen in FIG. 2 and in a recliner position as best seen in FIG. 3. Footrest extension linkage 106 further allows footrest mechanism 46 to remain in the extended position as chair 10 moves to the fully-reclined position as best seen in FIG. 4.

The discussion will next focus on the footrest extension linkage 106. As shown in FIG. 5, the footrest extension linkage 106 generally includes a handle, not shown, a shaft 108, an ottoman lock link 110, a release link 112, and a spring 114. As shown in FIG. 6, the shaft 108 is pivotally mounted between the seat mount plates 50 on each linkage mechanism 14. The handle or other activation means, not shown, is typically positioned on one side of chair 10 and is fixably mounted to shaft 108. Returning to FIG. 5, release link 112 is fixably mounted to the shaft 108 and is rotatably coupled to the ottoman lock link 110 at point 116. Ottoman lock link 110 is rotatably coupled to the footrest mechanism 46 at point 118 as will be further described below. Thus, ottoman lock link 110 serves to interconnect the release link 112 and the footrest mechanism 46. Spring 114 is coupled to the ottoman lock link 110 at point 120 on one end and is coupled to a forward portion of seat mount plate 50 on the opposite end.

Returning to FIGS. 4 and 5, the footrest mechanism 46 will now be discussed. The footrest mechanism 46 includes a drive link 122, a front link 124, a rocker link 126, a mid-link 128, a rear link 129, and a bracket 130. Drive link 122 includes a drive end 132, a pivot 134, and an upper end 136. The drive link 122 is coupled to the bracket 130 at upper end 136 and is rotatably coupled to the rear link 129 at drive end 132. Opposite the connection to the drive end 132, rear link 129 is coupled to a forward portion of the seat mount plate 50. Further, the ottoman lock link 110 is coupled to the rear link 129 at point 118. Front link 124 includes an upper end 138, a pivot point 140, and a lower end 142. Front link 124 is rotatably coupled to the seat mount plate 50 at upper end 138 and is rotatably coupled to the rocker link 126 at lower end 142. Front link 124 is pivotably coupled to the drive link 122 at pivots 134, 140 and, thus, forms a scissor linkage with drive link 122. Opposite the connection of rocker link 126 to front link 124, rocker link 126 is coupled to bracket 130. The bracket 130 is generally rectangular and contains a number of apertures 144 for fastening the various links to footrest 18, not shown. The mid-link 128 is shaped as shown and coupled to the rocker link 126 at point 146 and to the drive link 122 at point 148.

Referring again to FIGS. 4 and 5 and the discussion of the linkage mechanism 14, the drive mechanism 44 will now be described. The drive mechanism 44 includes an ottoman drive bell crank 150 and an ottoman drive link 152. The ottoman drive bell crank 150 is shaped as shown and includes an upper portion 154 and a lower portion 156. The upper portion 154 is rotatably coupled to the rocker base plate 48 at point 158 and to an end portion of rear lift link 62 at point 160. A wheel 162 is rotatably coupled to lower portion 156 of ottoman drive bell crank 150 at point 164. The ottoman drive link 152 is rotatably coupled to lower portion 156 of ottoman drive bell crank 150 at point 166. Opposite the connection to the ottoman drive bell crank 150, a forward portion of the ottoman drive link 152 is rotatably coupled to the rear link 129 at point 168.

Figure 8:
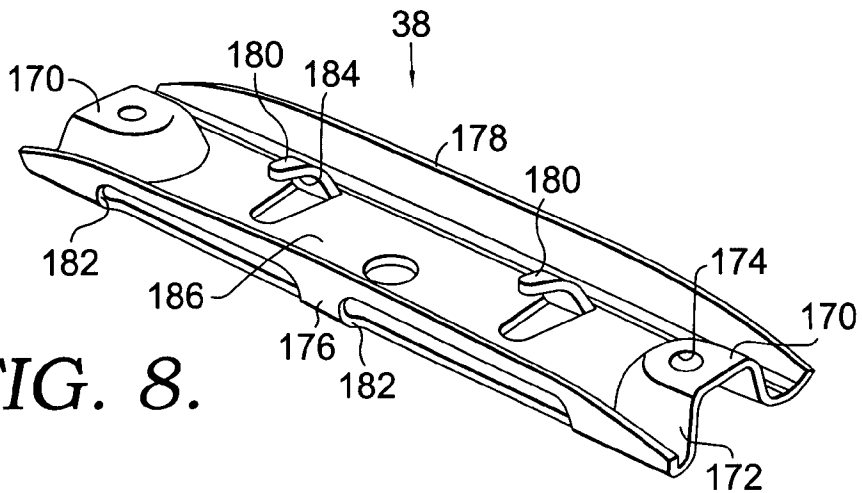
FIG. 8 is an isometric view of a spring retention device.

Turning now to FIGS. 6 and 7, the spring retention devices 38 will be discussed. The spring retention devices 38 are coupled to the first and second pairs of cross rails 32, 33 with a set of springs 40 coupled therebetween. As best seen in FIG. 8, the spring retention device 38 is shaped as shown and formed from stamped steel or any other suitable material. The spring retention device 38 is generally planar, presenting top and bottom surfaces and front, rear, and side edges. The spring retention device 38 includes a pair of mounting portions 170 which facilitate fastening the spring retention device 38 to the cross rails 32, 33. The mounting portions 170 include a raised portion 172 and an aperture 174. The spring retention device 38 also includes a pair of protrusions 176, 178 located at each side of the spring retention device 38 and a pair of depending tabs 180. One protrusion 176 has a pair of elongate apertures 182 formed therein. Referring now to FIGS. 7 and 8, the elongate apertures 182 are provided to receive the set of springs 40 in order to couple the springs 40 to the first and second pairs of cross rails 32, 33.

As further illustrated in FIG. 8, the tabs 180 are coupled to the spring retention device 38, and protrude above the spring retention device 38 by a distance sufficient enough to define a space between a lower surface 184 of the tab 180 and an upper surface 186 of the spring retention device 38. Preferably, tabs 180 are integrally formed with spring retention device 38 in a metal forming operation by cutting the desired shape and raising the tabs 180. Tabs 180 also serve to retain the springs 40.

The operation of the recliner 10 is best described with reference to FIGS. 2-5. FIG. 2 represents the recliner 10 in the closed, chair position, position one. FIG. 3 represents the recliner 10 in the open, recliner position, position two. FIG. 4 represents the ottoman recliner 10 in the fully-reclined position, position three. Referring now to FIG. 5, if the occupant desires to convert from position one to position two, the user rotates the handle or other activation means, not shown, rearwardly. Rearward rotation of the handle or other activation means, in turn, causes a downward rotation of the release link 112 coupled thereto through shaft 108. The downward rotation of the release link 112 unlocks the ottoman lock link 110. As best seen in FIGS. 3 and 5, once the ottoman lock link 110 is unlocked, the weight of the user causes the recliner mechanism 42 to move forward. The spring 114 serves to maintain the footrest extension linkage 106 in the locked position and, thus, the footrest mechanism 46 in the closed position, position one. The spring 114 further functions to assist opening footrest mechanism 46 from position one to position two once the footrest extension linkage 106 has been unlocked. Still further, the spring 114 assists in holding the footrest mechanism 46 in the extended position.

In addition, the drive mechanism 44 also operates to move the footrest extension linkage 106 to the extended position. Once the footrest extension linkage 106 has been released, the ottoman drive bell crank 150 rotates in a clockwise manner, with reference to FIG. 2, about point 158. This clockwise motion of the ottoman drive bell crank 150 moves the ottoman drive link 152 toward the front of the recliner 10. This translation of the ottoman drive link 152, along with the bias of spring 114 of the footrest extension linkage 106, serves to move the footrest mechanism 46 to the recliner position, position two, as shown in FIG. 3. The clockwise rotation of the ottoman drive bell crank 150 causes the wheel 162 to contact side rail 30. The contact between wheel 162 and side rail 30 prevents the chair 10 from rocking relative to support frame 12.

Referring now to FIGS. 3-5, to move from position two to position three, an additional force as represented by reference numeral 186 is applied to back bracket 82 via back 20 (not shown). The force 186 applied to the back bracket 82 causes a clockwise rotation, with reference to FIGS. 3 and 4, of back bracket 82. The clockwise motion of back bracket 82 causes an upward pulling force at point 98, represented by reference numeral 188, and a downward pushing force at point 100, represented by reference numeral 190. The rotation of the back bracket 82 and the downward force 190 on the upright link 84 also causes an upward rotation of rear lift link 62 through point 102, FIG. 5, about point 160, as seen in FIGS. 3 and 4. The upward rotation of the rear lift link 62, in turn, causes an upward rotation of the front lift link 60 through the slot 70 and pin 78. These forces, in combination, cause the front and rear lift links 60, 62 to raise the seat mount plate 50 at points 68, 80, as the recliner moves from position two to position three.

Referring now to FIGS. 3 and 4, the combination of forces 188, 190 further causes an upward rotation of ottoman drive link 152 about pivot 166. It should be noted that point 166 remains stationary during movement from position two, shown in FIG. 3, to position three, shown in FIG. 4. The seat 16 coupled to the seat mount plate 50 rises as the back bracket 82 is rotated rearwardly thereby creating a counterbalance with the weight of the user in the seat 16 and the rise of the seat 16. As the seat 16 is rising, the forward portion of the ottoman drive link 152, coupled to rear link 129 at point 168, rotates upwardly in an arc-like manner about point 166. The forward portion of the ottoman drive link 152 rises at a radius about point 166. The rise of the seat 16 is controlled such that the point 168 of the ottoman drive link 152 travels in a constant arc about the pivot point 166. This has the effect of keeping pressure on the recliner mechanism 42 thereby holding it in the extended position while the back bracket 82 is being rotated.

The above-described linkage mechanism provides a drive linkage for a rocker recliner chair that is less complex than other prior art linkages. The mechanism utilizes fewer links, and thus less material, while achieving the same functionality. To aid in the illustration a prior art mechanism is briefly described.

Figure 9:
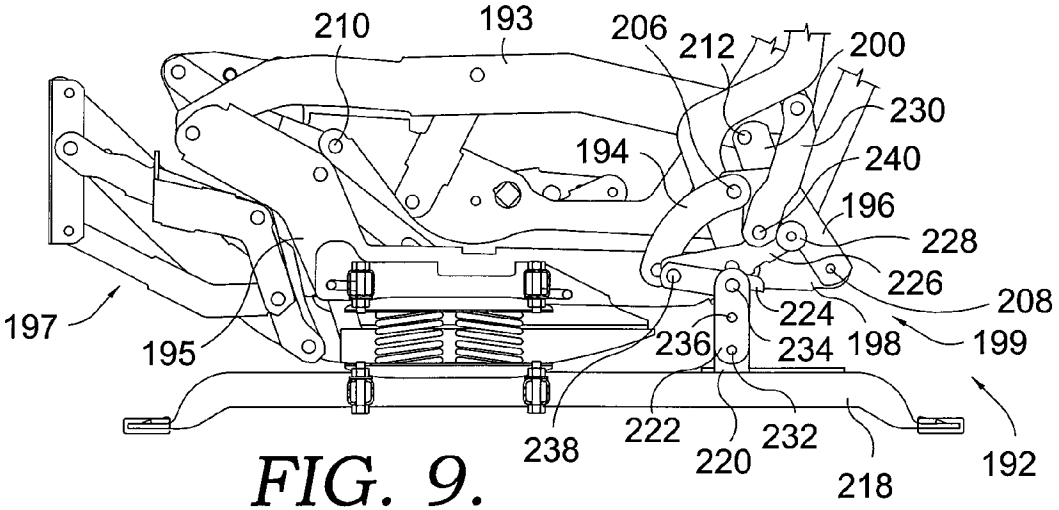
FIG. 9. PRIOR ART
FIG. 9 is a cross-sectional view of a prior art embodiment with the drive mechanism in the closed position.
Figure 10:
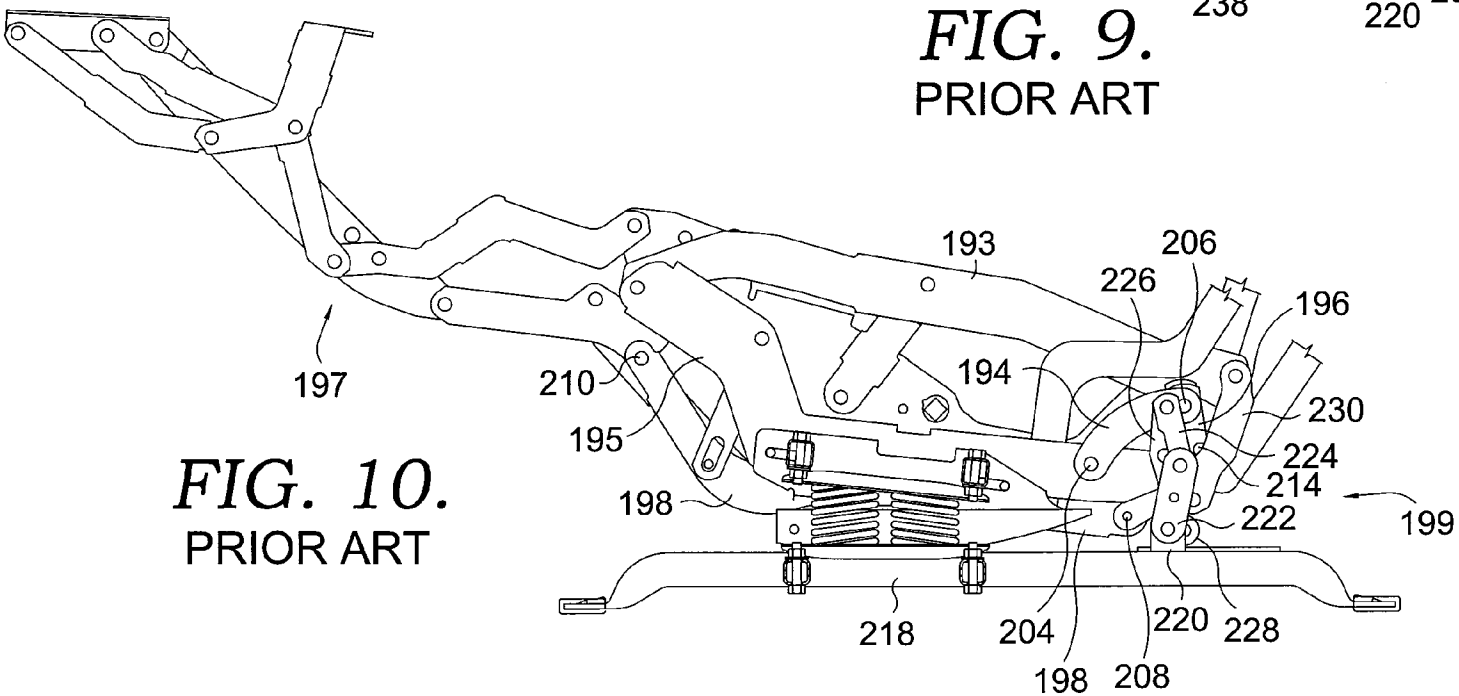
FIG. 10. PRIOR ART
FIG. 10 is a view similar to FIG. 9, but showing the drive mechanism in the open, extended position.

Referring now to FIGS. 9 and 10, a previous embodiment of a drive linkage for a rocker recliner chair is shown and designated by numeral 192. With reference to FIGS. 9 and 10, the previous embodiment of the rocker recliner chair and the recliner 10 contain similar configurations with a few important exceptions. It will be understood by one of ordinary skill in the art that the previous embodiment contains, among other things, a seat mount plate 193, a rocker base plate 195 and a footrest mechanism 197. The differences between the previous embodiment, shown in FIGS. 9 and 10, and the recliner 10 that is described above relate to the drive mechanism 44. As shown in FIG. 4 the drive mechanism 44 contains the ottoman drive bell crank 150 and the ottoman drive link 152. As will be understood in the discussion below, the previous embodiment contains a drive linkage 192 and a rock blocker 199, both of which contain numerous links and connections. The ottoman drive bell crank 150 of the present invention is a single link, shaped as shown, that replaces the multiple links contained in the previous embodiment. The ottoman drive bell crank 150 of the present invention also serves to replace the rock blocker linkage 199 contained in the previous embodiment.

As shown in FIGS. 9 and 10, the drive linkage 192 includes a rear control link 194, a seat bell crank 196, an ottoman drive link 198, and a backrest bell crank 200. Rear control link 194 is pivotally coupled with rocker base plate 195 at point 204 and pivotally coupled with seat bell crank 196 at point 206. Seat bell crank 196 is also pivotally coupled with ottoman drive link 198 at point 208. Ottoman drive link 198 extends from the rear portion of the chair and is coupled to the footrest mechanism 197 at point 210 as is well understood by one of ordinary skill in the art. Backrest bell crank 200 is pivotally coupled to a rear portion of seat mount plate 193 at point 212. An intermediate portion of backrest bell crank 200 is pivotally coupled with an intermediate portion of seat bell crank 196 at point 214.

The previous embodiment further includes a rock blocker linkage 199 that prevents chair 10 from rocking relative to a support frame 218 when chair 10 is in the intermediate position or fully reclined position. As best seen in FIG. 9 and 10, the rock blocker linkage 199 is generally situated at the rear portion of chair 10 and includes a base link 220, an anchor link 222, a connector link 224, a roller link 226, a roller 228, and a securing link 230. Base link 220 is fixedly mounted to support frame 218 by a fastener, weldment or the like. One end of anchor link 222 is pivotally coupled to base link 220 at point 232 and the opposite end is pivotally coupled to connector link 224 at point 234. Anchor link 222 has a stop pin 236 mounted thereto that is positioned to contact connector link 224 when chair 10 is in the intermediate and fully reclined positions. Connector link 224 is also pivotally coupled to roller link 228 by point 238. An intermediate portion of roller link 228 is pivotally coupled to a rear portion of rocker base plate 193 and roller 228 is rotatably mounted to the distal end of roller link 226 and is adapted to contact the flat portion of support frame 218 when chair 10 is in the intermediate or fully reclined positions. One end of securing link 230 is pivotally mounted to an intermediate portion of roller link 226 by point 240, and the opposite end of link 230 is pivotally coupled to the rear portion of seat mount plate 193.

As can best be seen when comparing FIGS. 6 and 4, the drive linkage 192 and rock blocker linkage 199, both consisting of multiple links, are replaced by the ottoman drive bell crank 150 and the ottoman drive link 152. The ottoman drive bell crank 150 and the ottoman drive link 152, acting within the mechanism, achieve the desired motion and eliminate a number of links and pivot points as compared to the previous linkage mechanisms known in the art. The ottoman drive bell crank 150 and ottoman drive link 152 therefore provide a less complex mechanism that can still achieve the desired motion.

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. A drive mechanism for a rocker recliner chair having a base, a recliner mechanism mounted on the base and including a rocker base plate, a seat mount plate, a rear lift link and a sequence link, the drive mechanism comprising:

a bell crank being rotatably coupled to the rocker base plate at a first pivot and to the rear lift link at a second pivot consistently rearward of the first pivot, wherein the rocker base plate is slidably coupled with the sequence link, the sequence link is rotatably coupled to the seat mount plate, and the rear lift link is movably coupled with the seat mount plate, as well as a footrest mechanism; and a drive link having first and second ends, the first end being rotatably coupled to the footrest mechanism and the second end being rotatably coupled to the bell crank at a third pivot such that the bell crank rotates about the recliner mechanism to move the chair between a first position and a second position.

2. The drive mechanism of claim 1, wherein the bell crank has an upper portion and a lower portion, with the lower portion of the bell crank having a wheel coupled thereto.

3. The drive mechanism of claim 2, wherein a downward force on the upper portion of the bell crank moves the chair from the second position to a third position.

4. The drive mechanism of claim 3, wherein the rocker base plate is flexibly coupled to the base, and wherein the wheel contacts the base to prevent the chair from rocking relative to the base when the chair is in the second and third positions.

5. The drive mechanism of claim 4, wherein the first end of the drive link travels in a constant arc about the lower portion of the bell crank as the chair moves from the second position to the third position.

6. The drive mechanism of claim 5, wherein the first position is a closed position such that the footrest mechanism is substantially retracted.

7. The drive mechanism of claim 6, wherein the second position is an open position such that the footrest mechanism is substantially extended.

8. The drive mechanism of claim 7, wherein the third position is a fully reclined position.

9. The drive mechanism of claim 7, wherein the bell crank is rotatably coupled to the rocker base plate and to the rear lift link at the upper portion thereof, and is rotatably coupled to the second end of the drive link at the lower portion thereof, wherein, based on positions of the first pivot, the second pivot, and the third pivot, the bell crank is configured rotate during adjustment between the first position and the second position of the rocker recliner chair, and wherein the rotation of the bell crank causes the wheel to move forward, relative to the recliner mechanism, upon adjustment from the first position to the second position such that the wheel is proximate to the base.

10. The drive mechanism of claim 1, wherein the slidable coupling of the rocker base plate with the sequence link comprises a member fixed to the rocker base plate that is captured within a slot disposed on the sequence link such that the member is allowed to traverse the slot upon the slot assuming a substantially vertical orientation when the rocker recliner chair is adjusted to the second position or the third position.

11. The drive mechanism of claim 1, wherein the slidable coupling of the rocker base plate with the sequence link comprises a member fixed to the rocker base plate that is captured within a slot disposed on the sequence link such that the member is allowed to traverse the slot upon the slot assuming a substantially vertical orientation when the rocker recliner chair is adjusted to the second position or the third position, and wherein, when adjusted to the third position, a location of the member within the slot resists a substantial collapse of the footrest mechanism.

* * * * *